United States Patent [19]

Anselrode

[11] 4,039,396

[45] Aug. 2, 1977

[54] METHOD FOR MANUFACTURING A SEAMLESS CYLINDRICAL SCREEN GAUZE

[75] Inventor: Lodewijk Anselrode, St. Anthonis, Netherlands

[73] Assignee: Stork Brabant B.V., Boxmeer, Netherlands

[21] Appl. No.: 638,062

[22] Filed: Dec. 5, 1975

[30] Foreign Application Priority Data

Dec. 24, 1974 Netherlands ..... 7416890

[51] Int. Cl.[2] ..... C25D 1/02; C25D 1/08

[52] U.S. Cl. ..... 204/11; 101/128.4; 204/9

[58] Field of Search ..... 204/16, 11, 9; 101/127, 101/128.4

[56] References Cited

U.S. PATENT DOCUMENTS

| | | | |
|---|---|---|---|
| 2,370,970 | 3/1945 | Keeleric | 204/16 |
| 3,537,960 | 11/1970 | Esola et al. | 204/16 |
| 3,591,466 | 7/1971 | Heiman | 204/16 |
| 3,681,208 | 8/1972 | Anselrode | 204/11 |
| 3,759,800 | 9/1973 | Reinke | 204/16 |

*Primary Examiner*—T. M. Tufariello

*Attorney, Agent, or Firm*—Edmund M. Jaskiewicz

[57] ABSTRACT

Method for manufacturing a seamless cylindrical screen gauze by a metalizing process, in which one starts from a fibre fleece which is temporarily adhered to a supporting surface and subjected to a galvanoplastic operation.

6 Claims, No Drawings

METHOD FOR MANUFACTURING A SEAMLESS CYLINDRICAL SCREEN GAUZE

BACKGROUND OF THE INVENTION

My invention relates to a method for manufacturing a seamless cylindrical screen gauze composed of a fibre product said method comprising the steps of supporting the product upon a cylinder and embedding the fibres in metal by means of a galvanoplastic process. Such a method is known from and described in my Pat. No. 3,681,208.

The fibre product used with these methods consits of a wire of metal or synthetic material, the wire constituting a reinforcement for the screen gauze. On performing these known methods a screen gauze is obtained with a perfectly regular mesh pattern. This causes sometimes the disadvantage that when this screen gauze is used in so-called screen printing, the problem arises in that MOIRE-effects may be produced.

SUMMARY OF THE INVENTION

My invention aims to provide a method by which a screen gauze is manufactured which does not produce any MOIRE-effect. This method starts by using a fleece of disordered fibres, which fleece is adhered to the surface of the supporting cylinder, whereupon the galvanoplastic treatment step is performed and finally the adhesion of the fibres to the cylinder is eliminated.

Due to these method steps the fibres will likewise serve as reinforcement, but as they are disorderly arranged, an arbitrary pattern of perforations will be obtained which within particular limits are mutually dissimilar as to shape and size. As a consequence the aforementioned object of avoiding the MOIRE-effect is completely attained.

The fleece of disordered fibres required in performing the method according to my invention, is sometimes available in the textile industry under the denomination "non-woven random web". My invention allows, however, to manufacture the required fleece in situ, by preparing the fleece of disordered fibres on the supporting cylinder with a suspension of these fibres in a carrying medium. The screen gauze to be manufactured has preferably a premeability ranging from 5 to 30 %.

Various methods are conceivable to produce the fleece. For instance a cylindrical sieve may be used as supporting surface, while during the galvanoplastic treatment the pressure within said sieve is caused to be lower than the outside pressure. This pressure difference ensures the required temporary adherence of the fibres to the supporting surface, avoiding any fibres to be washed away during the galvanoplastic treatment in a liquid bath.

The supporting surface may also consist of a smooth, non-porous and electrically non-conducting cylinder with a provision effecting adhesion of the fibres to the surface of the cylinder. When using synthetic fibres this provision may consist of a coating, whereas with metal fibres a temporarily or permanently magnetized surface of the supporting cylinder may be provided.

DESCRIPTION OF PREFERRED MODES OF REALIZATION

An important element to be used in the method according to my invention consists of the supporting cylinder upon which the fleece or the fibres should be temporarily fixed during the galvanoplastic treatment.

In this connection the following major possibilities are mentioned:

I. a cylindrical sieve with an electrically non-conducting wall;

II. a smooth, non-porous, and non-conducting cylinder with an adhesive coating;

III. a smooth, non-porous, and non-conducting cylinder which is magnetic or can be magnetized;

IV. a cylinder with a non-conducting surface with a screen pattern of non-conducting material.

EXAMPLE I

The cylindrical sieve is provided with an inner internal suction device. The perforations of the sieve should be small to prevent the fibres from being entirely or partially sucked into the cylinder. Moreover these perforations should be ordered in such a way and be sufficient in number to allow a regular building up of the fleece along the surface of the cylinder.

The fibres remain fixed on the sieve even during the galvanoplastic treatment, since an underpressure is maintained within the sieve. Another possibility, for depositing the fibres from an aqueous suspension upon the sieve, is to inject a strongly diluted suspension of electrically conducting fibres, or fibres which are made conductive, into the galvanic bath prior to the electrolytic process proper. The fibres may also be applied by means of a vigorously turbulent mass of air in which the strongly diluted fibres are distributed as regularly as possible. The carrying medium of the suspension may therefore consist of liquid or gas.

EXAMPLE II

First a very thin layer is applied to the smooth electrically non-conducting cylinder, said layer having adhering properties which do not disappear on account of a subsequent process like drying and/or polymerising. This adhesive layer should, however, have the property of disappearing after a special treatment e.g. by using a strong basic solution or a solvent. Examples of suitable adhesives are: acryl-latices and epoxy resins or epoxy resin solutions.

For obtaining a strong adherence to the adhesive layer it is necessary to blow the fibres under some force into said layer. Preferably an air gun is used which is moved with a uniform velocity at some distance of the rotating cylinder. From this gun the individual conductive fibres, or fibres made conductive, are blown into the sticky surface. If necessary the fibres can be slightly pressed by a rotating roller with a top layer that is prohibitive to adherence, like TEFLON. Hereafter the surface of the cylinder is dried and/or polymerised. After the formation by electrolysis of the metal layer on the fibres forming the thin fleece, the adhesive layer is dissolved and the final product, that is to say the cylindrical screen is removed from the supporting surface.

EXAMPLE III

When a smooth, non-porous, and electrically non-conductive cylinder with magnetic properties is used, it is necessary that the magnetic lines of force extend truly uniformly on the entire supporting surface. The electrically conducting fibres should have sufficiently strong magnetic properties. For that purpose the fibres may consist of iron, steel chromium steel etc. Synthetic fibres may also be used which firstly should be provided with a nickel coating after having been made electrically conductive.

The application of the fibres may be effected from an aqeous suspension by complete or partial immersion of the rotating supporting cylinder in a trough, containing a strongly diluted fibre suspension. One can, however, also sprinkle the supporting cylinder with a fibre suspension. Gas f.i. a strongly turbulent air current, containing fibres in a strong dilution, can also be used as a carrier.

EXAMPLE IV

When using a supporting cylinder with a non-conductive surface to which a pattern of conductive material is applied, or when a supporting surface is used to which a pattern of non-conductive material is applied, one can proceed in conformity to the contents of my aforementioned prior Patent. The required adhesion of the fibres is obtained according to examples II and III.

What I claim is:

1. A method of manufacturing a seamless cylindrical metalized screen gauze from fibres comprising the steps of supporting upon a cylindrical surface a plurality of disordered fibres to define a fleece, temporarily adhering the fibres to the surface, precipitating metal upon the fibres by a glavanoplastic process while the fibres are adhered to the surface to embed the fibres in metal, eliminating the adherence of the fibres to the cylindrical surface, and removing the metal reinforced cylindrical gauze from the supporting cylindrical surface to provide a thin cylindrical screen.

2. Method according to claim 1, in which the fleece of disordered fibres is obtained by means of a suspension of these fibres in a carrying medium.

3. Method according to claim 1, in which a cylindrical sieve is used as supporting surface while during the galvanoplastic treatment the pressure within said sieve is maintained at a lower value than the outside pressure.

4. Method according to claim 1, in which a smooth, non-porous, and electrically non-conductive cylinder is used as supporting surface with a provision to effect the adherence of the fibres to the surface of said cylinder.

5. Method according to claim 1, in which a cylinder is used as supporting surface, said cylinder being provided with a surface of electrically non-conducting material, a pattern of electrically conductive material being provided in said material.

6. A seamless cylindrical metalized screen gauze made by supporting upon a cylindrical surface a plurality of disordered fibres to define a fleece, temporarily adhering the fibres to the surface, precipitating metal upon the fibres by a galvanoplastic process while the fibres are adhered to the surface to embed the fibres in metal, eliminating the adherence of the fibres to the cylindrical surface, and removing the metal reinforced cylindrical gauze from the supporting cylindrical surface to provide a thin cylindrical screen.

* * * * *